United States Patent [19]

Yunoki

[11] Patent Number: 4,974,315

[45] Date of Patent: Dec. 4, 1990

[54] SLIDER HOLDING APPARATUS

[75] Inventor: Akio Yunoki, Namerikawa, Japan

[73] Assignee: Yoshida Kogyo K.K., Tokyo, Japan

[21] Appl. No.: 346,341

[22] Filed: Apr. 28, 1989

Related U.S. Application Data

[63] Continuation of Ser. No. 66,064, Jun. 24, 1987, abandoned.

[30] Foreign Application Priority Data

Jun. 25, 1986 [JP] Japan ..... 61-148683

[51] Int. Cl.[5] ..... B23P 19/04

[52] U.S. Cl. ..... 29/768; 29/766; 269/57; 901/14; 901/25

[58] Field of Search ..... 29/766, 767, 768, 769, 29/770, 408, 409, 410; 901/14, 24, 25; 269/57, 61

[56] References Cited

U.S. PATENT DOCUMENTS

| | | | |
|---|---|---|---|
| 3,001,651 | 9/1961 | Fekete et al. | 901/25 X |
| 3,714,698 | 2/1973 | Fukuroi | 29/768 X |
| 3,964,615 | 6/1976 | Silvis et al. | 29/768 X |
| 4,049,155 | 9/1977 | Kawakami et al. . | |
| 4,355,461 | 10/1982 | Doori | 29/768 |
| 4,419,041 | 12/1983 | Rose | 901/24 X |

FOREIGN PATENT DOCUMENTS

| | | | |
|---|---|---|---|
| 0025148 | 8/1980 | European Pat. Off. . | |
| 0045876 | 7/1981 | European Pat. Off. . | |
| 2129954 | 3/1973 | France . | |
| 51-2026 | 1/1976 | Japan . | |
| 541664 | 3/1977 | U.S.S.R. | 901/14 |

*Primary Examiner*—Joseph M. Gorski

*Attorney, Agent, or Firm*—Hill, Van Santen, Steadman & Simpson

[57] ABSTRACT

A slider holding apparatus includes a slider holder for holding thereon a slider, and orientating means for angularly moving the slider holder on its vertical axis to adjust the orientation of the slider held on the slider holder.

1 Claim, 6 Drawing Sheets

SLIDER HOLDING APPARATUS

This application is a continuation of my copending application, U.S. Ser. No. 07/066064 now abandoned.

BACKGROUND OF THE INVENTION

1. Field of the Invention

The present invention relates to an apparatus for holding a slider in position during the threading of a slide fastener chain through the slider in the manufacture of a slide fastener.

2. Prior Art

It has been customary to hold a slider in position during the threading of a slide fastener chain through the slider in the manufacture of a slide fastener. The direction in which the fastener chain is threaded through the slider is dependent on whether the fastener chain is of the type in which each pair of opposed stringers is engaged, or of the type in which each pair of opposed stringers is disengaged; that is, the fastener chain of the first type is threaded from the rear end of the slider (toward the neck), whereas the fastener chain of the second type is threaded from the front end of the slider. However, because the fastener chain is automatically fed toward the slider in a non-variable direction, the slider as held is required to be properly oriented relative to the fastener chain.

A prior art apparatus as disclosed in U.S. Pat. No. 4,049,155, issued Sept. 20, 1977 includes a slider holder having at its upper end a slider support. The slider holder is vertically movable between a lower position in which the slider support receives and holds a slider supplied upside down from a slider chute, and an upper position in which the slider support is disposed remotely from a slider chute for the threading of a slide fastener chain through the slider. However, the slider holder is unable to move angularly on its vertical axis and hence unable to adjust the orientation of the slider held on the slider support. Therefore, in order to deal with either type of the slide fastener chain, it is necessary to arrange two identical apparatus in opposite directions, which occupies too much space and causes an increased cost of manufacture.

SUMMARY OF THE INVENTION

It is therefore an object of the present invention to provide a slider holding apparatus which is inexpensive, compact in size and can adjust the orientation of a slider relative to a slide fastener chain.

According to the present invention, an apparatus for holding a slider comprises a slider holder for holding thereon a slider, and orientating means for angularly moving the slider holder on its vertical axis to adjust the orientation of the slider held on the slider holder.

Many other objects, advantages and additional features of the present invention will become manifest to those versed in the art upon making reference to the detailed description and the accompanying sheets of drawings in which two preferred structural embodiments incorporating the principles of the present invention are shown by way of illustrative example.

DETAILED DESCRIPTION

Figure 1:
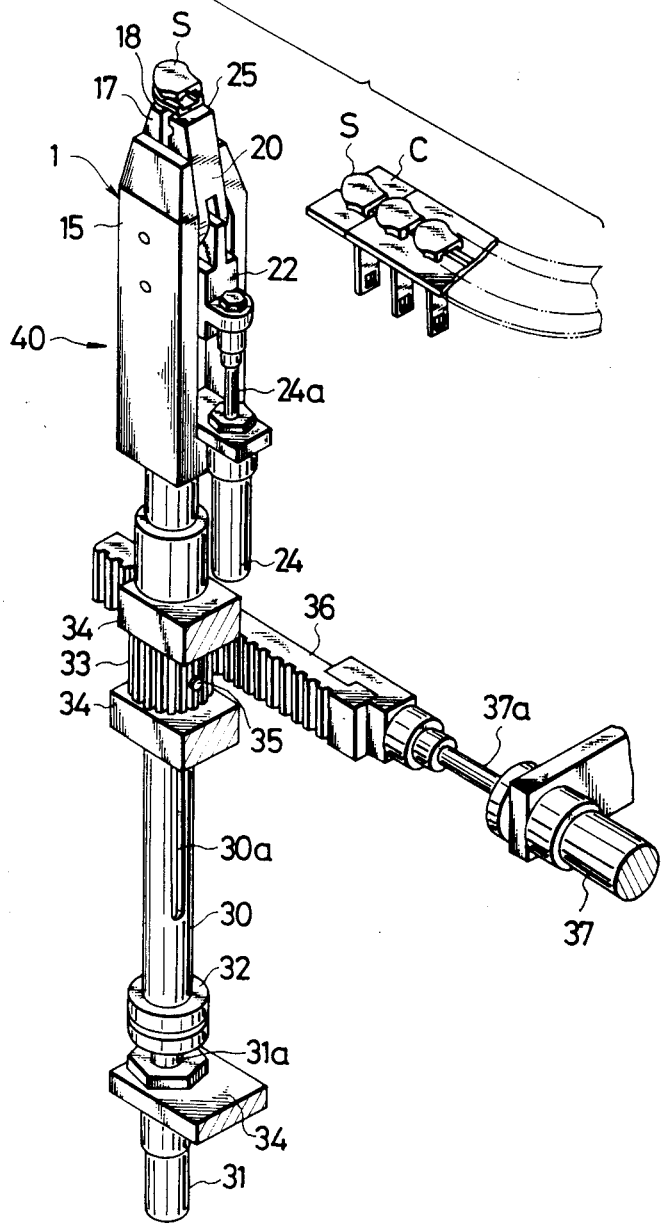
FIG. 1 is a perspective view of an apparatus according to the present invention.

FIGS. 1 through 3 and 7 show an apparatus 40 for holding a slider S in position during the threading of a slide fastener chain F through the slider S. The slider S includes a slider body 10, and a pull tab 12 pivotally connected to the slider body 10. The pull tab 12 has an aperture 12*a*. The slider S is supplied upside down from a slider chute C to the apparatus 40 along a horizontal feed path, with the pull tab 12 hanging from the slider body 10.

The apparatus 40 generally comprises a slider holder 1 including a holder body 15, a supporting arm 20, and a locking lever 26.

The holder body 15 has a pair of confronting vertical walls 15*a*, 15*a* defining an upwardly opening space 16 that is also opening rearwardly (toward the chute C) for receiving the pull tab 12 as the slider S is supplied to the apparatus 40. The holder body 15 also has a slider support 17 secured at opposite sides to upper inner surfaces of the walls 15*a*, 15*a* and extending across the space 16, the slider support 17 having an upper portion projecting upwardly beyond the walls 15*a*, 15*a*. At the upper end of the slider support 17, a first slider seat 18 is provided. The slider support 17 also has a vertically horizontal bore 17*a* below the first slider seat 18.

Figure 2:
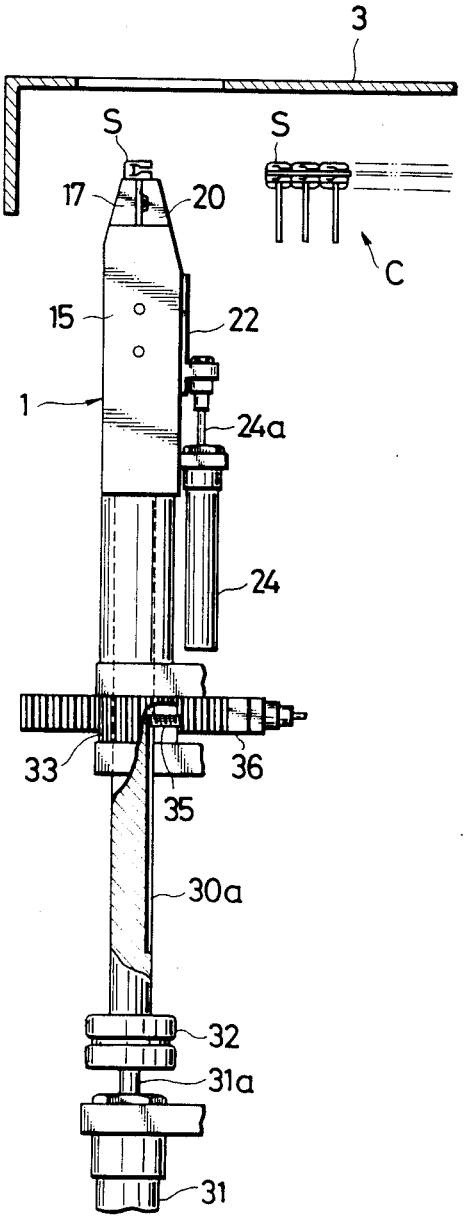
FIG. 2 is a side elevational view, with parts broken away, of the apparatus, illustrating the manner in which a slider is held on a slider holder.
Figure 3:
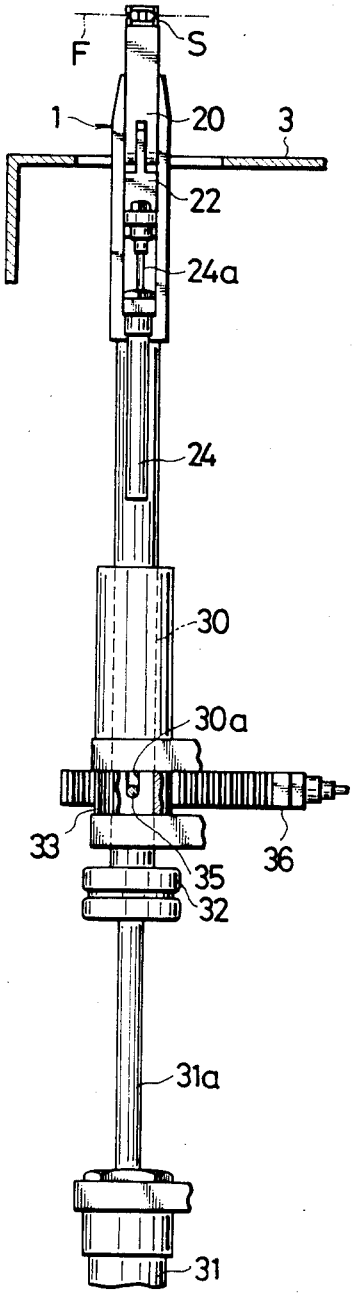
FIG. 3 is a front elevational view, with parts broken away, of the apparatus, illustrating the manner in which a slide fastener chain is threaded through the slider held on the slider holder.

The supporting arm 20 is disposed in the space 16 rearwardly of the slider support 17 and is pivotally connected at one end to the vertical walls 15*a*, 15*a* by a first pin 21 below the slider support 17. The arm 20 is also connected to an actuator bar 22 by a second pin 23 slightly spaced from the first pin 21 toward the other end of the arm 20. The actuator bar 22 is disposed between the vertical walls 15*a*, 15*a* and is operatively connected to a piston rod 24*a* of an air cylinder 24 for vertical movement along the walls 15*a*, 15*a*. The arm 20 is thus angularly movable about the first pin 21 between an inclined position (FIG. 7) and an upright position (FIGS. 1 through 3). The arm 20 has at one end a cam surface 20*a* and at the other end a second slider seat 25.

The locking lever 26 is disposed in the space 16 forwardly of the slider support 17 and is pivotally connected at a central portion thereof to the vertical walls 15*a*, 15*a* by a third pin 27 below the first pin 21. The cam surface 20*a* of the supporting arm 20 is slidably engageable with a rear surface of the lever 26 above the third pin 27. The lever 26 has at the upper end a rearwardly directed locking projection 26*a*. A compression spring 28 acts between the lower end of the lever 26 and the holder body 15 to normally urge the lever 26 in the direction in which the locking projection 26*a* projects through the bore 17*a* of the slider support 17 into the space 16.

As shown in FIG. 1, the lower end of the holder body 15 is fixedly connected to one end of a vertical connecting shaft 30 which is rotatably connected at the other end to a piston rod 31*a* of an air cylinder 31 via a rotary joint 32. The connecting shaft 30 has an intermediate portion extending through a pinion 33 that is supported between a pair of confronting horizontal frame members 34, 34, the intermediate portion having a longitudinal key way 30*a*. The pinion 33 is connected to the connecting shaft 30 by a key 35 slidably received in the longitudinal key way 30*a* in the shaft 30. The pinion 33 is operatively engaged by a rack 36 that is horizontally movably connected to a piston rod 37*a* of an air cylinder 37.

With this arrangement, the slider holder 1 is vertically movable between a lower or slider holding position (FIG. 2) in which it receives and holds a slider S supplied from the slider chute C below a work table 33, and an upper or fastener chain threading position (FIG. 3) in which it projects upwardly beyond the work table 3 for the threading of a slide fastener chain F through the slider S. Further, the holder body 1 is angularly movable on its vertical axis (not numbered) so as to adjust the orientation of the slider S relative to the fastener chain F.

The operation of the apparatus 40 will now be described with reference to FIGS. 1 through 7.

The slider S is supplied along the feed path to the apparatus 40 until one half portion of the slider body 10 is supported on the first slider seat 18, during which time the pull tab 12 hanging from the slider body 10 is introduced through the space 16 to abut against the slider support 17, with the aperture 12*a* communicating with the bore 17*a*. At that time, the supporting arm 20 is in the inclined position in which the second slider seat 25 is positioned remotely from the first slider seat 18, and the cam surface 20*a* presses the locking lever 26 against the bias of the spring 28, thereby causing the locking projection 26*a* to retract into the bore 17*a*. Then, the piston rod 24*a* of the air cylinder 24 is extended to move the actuator bar 22 upwardly, thereby causing the arm 20 to angularly move about the first pin 21 toward the upright position (FIG. 1) in which the second slider seat 25 is positioned adjacent to and in horizontal alignment with the first slider seat 18. As a result, the other half portion of the slider body 10 is supported on the second slider seat 25. As the supporting arm 20 is angularly moved from the inclined position to the upright position, the lever 26 is allowed to turn under the bias of the spring 28, thereby causing the locking projection 26*a* to project through the bore 17*a* to engage the edge of the aperture 12*a* of the slider pull tab 12. The slider S is thus firmly held on the slider holder 1 in the slider holding position.

Then, if so required, the air cylinder 37 is actuated to move the rack 36 horizontally which in turn causes the pinion 33 and hence the connecting shaft 30 to rotate, so that the slider holder 1 is angularly moved on its vertical axis to adjust the orientation of the slider S held thereon.

Finally, the piston rod 31*a* of the air cylinder 31 is extended to move the connecting shaft 30 upwardly, thus causing the slider holder 1 to move to the fastener chain threading position as shown in FIG. 3.

Figure 4:
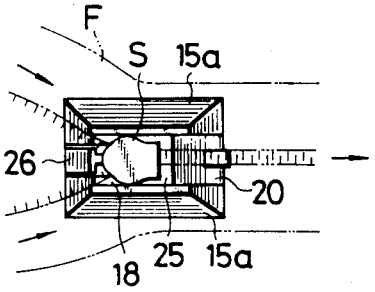
FIGS. 4 through 6 are plan views of the apparatus, showing various manners in which different types of slide fastener chains are threaded through the respective sliders.
Figure 5:
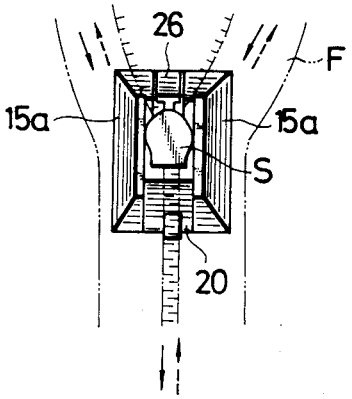
Figure 6:
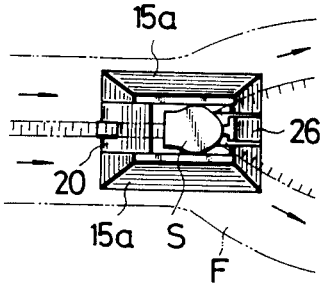
Figure 7:
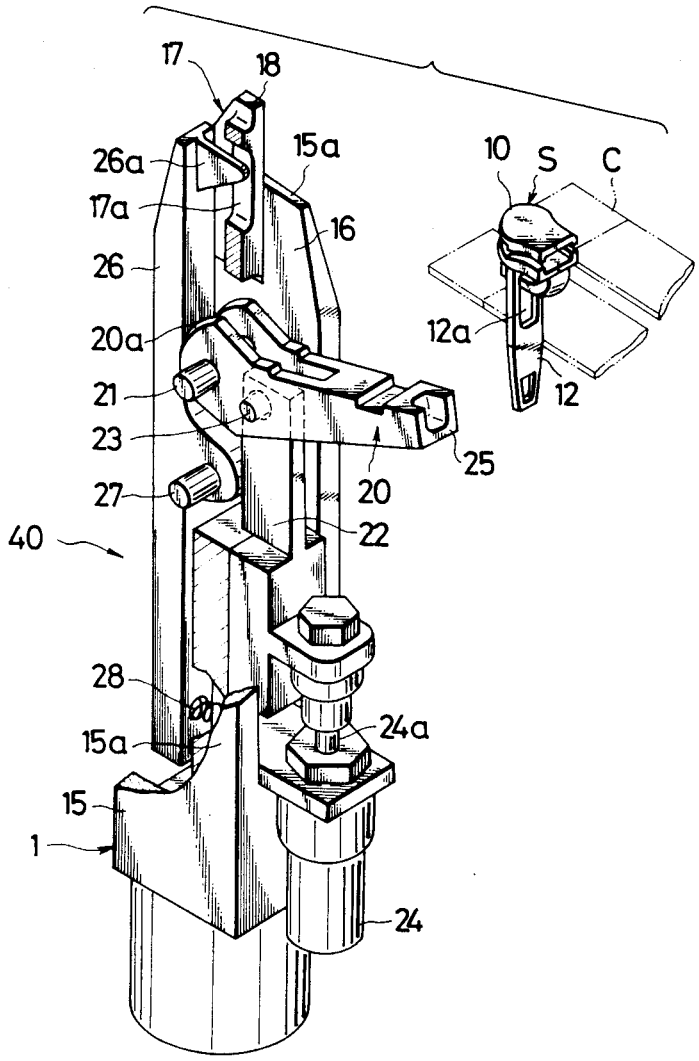
FIG. 7 is an enlarged perspective view, with parts broken away, of the slider holder.

The slide fastener chain F is threaded through the slider S in the following manners shown in FIGS. 4 through 6. As shown in FIG. 4, a pair of disengaged stringers of a slide fastener chain F is introduced into the front (adjacent to the neck) portion of the slider S and is then threaded rearwardly of the slider S as indicated by the arrows. In this instance, the slider S is in the original orientation as supplied from the slider chute C. In FIG. 5, the slider S has been angularly moved through an angle of 90° from the original orientation shown in FIG. 4. A pair of disengaged stringers is introduced into the front portion of the slider S to be threaded rearwardly of the slider S as indicated by the solid-line arrows, while a pair of engaged stringers is introduced into the rear portion of the slider S to be threaded forwardly of the slider S as indicated by the broken-line arrows. Further, FIG. 6 shows the manner in which a pair of engaged stringers of the slide fastener chain F is threaded forwardly of the slider S that has been angularly moved through 180° from the original orientation.

Figure 8:
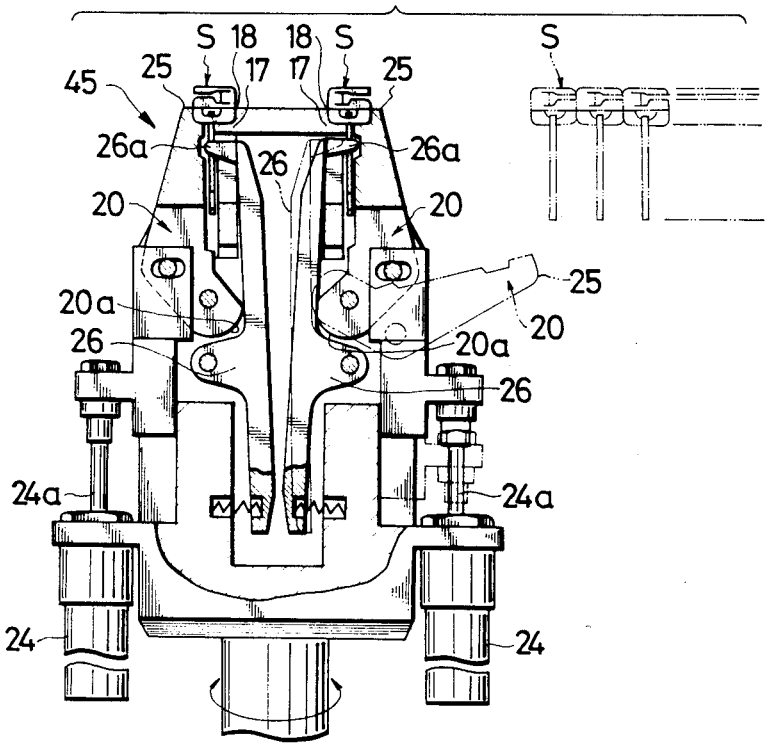
FIG. 8 is a fragmentary side elevational view, with parts in cross section, of a modified apparatus.
Figure 9:
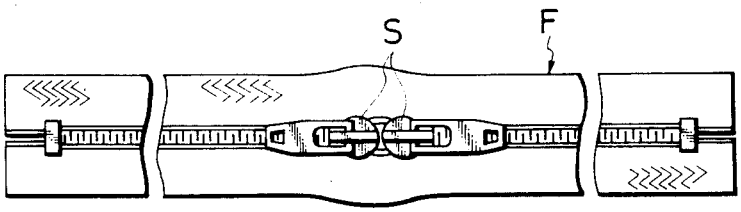
FIG. 9 is a fragmentary plan view of a pair of stringers of a slide fastener chain threaded through two confronting sliders by the apparatus of FIG. 8.

FIG. 8 shows a modified slider holder 45 which is different from the slider holder 1 of FIGS. 1 through 7 in that for holding two sliders S, S at a time, it includes a pair of interconnected slider supports 17, 17 each having at its upper end a first slider seat 18. The slider holder 45 also has a pair of horizontally oppositely directed supporting arms 20, 20 disposed outwardly of the pair of the slider supports 17, 17, each of said arms 20, 20 having at one end a second slider seat 25. Further, a pair of horizontally oppositely directed locking levers 26, 26 is disposed inwardly of the pair of the slider supports 17, 17. Thus, the individual double parts are disposed in a mirror-image relationship. FIG. 9 shows a pair of stringers of a slide fastener chain F, to which two sliders S, S are mounted by the slider holder 45 to provide a bidirectionally openable slide fastener that is suitably used such as in a suitcase.

Figure 10:
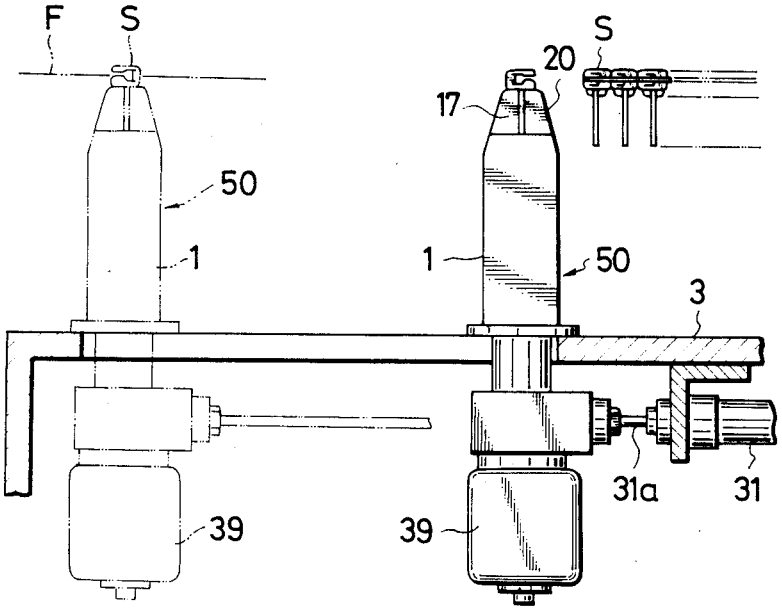
FIG. 10 is a side elevational view, with parts in cross section, of another modified apparatus.

FIG. 10 shows another modified apparatus 50 which is different from the apparatus 40 of FIG. 1 in that a slider holder 1 is disposed above a work table 3 and is connected to a piston rod 31*a* of an air cylinder 31 for horizontal movement above the work table 3 between a slider holding position and a fastener chain threading position. In the latter position, the slider holder 1 is disposed remotely from a slider chute C, thus preventing the slider chute C from impeding the threading of a slide fastener chain F. Further, the slider holder 1 is connected to a stepper motor 39 for angular movement on its vertical axis.

With the arrangements described above, because the slider holder is angularly movable on its vertical axis so as to adjust the orientation of the slider, the apparatus can be applied to various types of slide fastener chains.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for holding a slider during the threading of a slide fastener chain through the slider, said apparatus comprising:

(a) a slider holder for holding said slider on a vertical axis perpendicular to the direction of feed of a slide fastener chain, thereby allowing said slide fastener chain to be threaded through said slider;

(b) orientating means for angularly moving said slider holder about said vertical axis between an original orientation and a second orientation angularly displaced through 180° from said original orientation to adjust orientation of said slider to permit the threading of various types of slide fastener chains, said orientating means comprising a pinion operatively connected to said slider holder and a rack engaging said pinion and reciprocated by a first air cylinder; and (c) transfer means for moving said slider holder vertically between a first position in which said slider holder receives and holds the slider and a second position in which the slide fastener chain is threaded through said slider held by the slider holder, said transfer means comprising a second air cylinder having a piston rod operatively connected to said slider holder, and a connecting shaft having one end fixedly connected to said slider holder and an opposite end rotatably connected to said piston rod of said second air cylinder, said connecting shaft further having an intermediate portion extending through said pinion and having a longitudinal key way, said pinion being connected to said connecting shaft by a key slidably received in said longitudinal key way, such that said connect shaft is vertically movable without said pinion being vertically moved.

* * * * *